US005927642A

United States Patent [19]

Foster

[11] Patent Number: 5,927,642

[45] Date of Patent: Jul. 27, 1999

[54] WIRE DISPENSING SPOOL ATTACHMENT DEVICE

[76] Inventor: Roger D. Foster, 13472 Chestnut St., Westminster, Calif. 92683

[21] Appl. No.: 09/010,762

[22] Filed: Jan. 22, 1998

[51] Int. Cl.[6] ..... B65H 16/06; B65H 49/00

[52] U.S. Cl. ..... 242/598; 242/599.2; 242/129.6

[58] Field of Search ..... 242/598, 598.5, 242/599.2, 129.6, 129.7, 130, 134

[56] References Cited

U.S. PATENT DOCUMENTS 1,693,876 12/1928 Unruh, Jr. ..... 242/599.2

3,275,264 9/1966 Crow ..... 242/599.2

*Primary Examiner*—John Q. Nguyen

[57] ABSTRACT

A removable auxiliary spool device is provided including a spool having a pair of end plates maintained fixed in parallel planes via a central portion about which a string of material may be stored. Further provided is a pair of end assemblies each having an end face and an engagement portion coupled to the end face for being removably coupled to an associated one of the end plates of the spool thereby allowing convenient dispensing of the string of material.

6 Claims, 3 Drawing Sheets

WIRE DISPENSING SPOOL ATTACHMENT DEVICE

BACKGROUND OF THE INVENTION

1. Field of the Invention

The present invention relates to wire spools and more particularly pertains to a new wire dispensing spool attachment device for conveniently dispensing wire from a spool by way of removable attachments.

2. Description of the Prior Art

The use of wire spools is known in the prior art. More specifically, wire spools heretofore devised and utilized are known to consist basically of familiar, expected and obvious structural configurations, notwithstanding the myriad of designs encompassed by the crowded prior art which have been developed for the fulfillment of countless objectives and requirements.

Known prior art wire spools include U.S. Pat. Nos. 5,139,210; 5,320,301; 4,938,432; 4,967,978; 4,718,633; and U.S. Pat. Des. 323,531.

In these respects, the wire dispensing spool attachment device according to the present invention substantially departs from the conventional concepts and designs of the prior art, and in so doing provides an apparatus primarily developed for the purpose of conveniently dispensing wire from a spool by way of removable attachments.

SUMMARY OF THE INVENTION

In view of the foregoing disadvantages inherent in the known types of wire spools now present in the prior art, the present invention provides a new wire dispensing spool attachment device construction wherein the same can be utilized for conveniently dispensing wire from a spool by way of removable attachments.

The general purpose of the present invention, which will be described subsequently in greater detail, is to provide a new wire dispensing spool attachment device apparatus and method which has many of the advantages of the wire spools mentioned heretofore and many novel features that result in a new wire dispensing spool attachment device which is not anticipated, rendered obvious, suggested, or even implied by any of the prior art wire spools, either alone or in any combination thereof.

To attain this, the present invention generally comprises a pair of end assemblies each including a closed end face with a planar circular configuration. The end faces of the end assemblies thus each have an outboard face, an inboard face, and a periphery formed therebetween. A plurality of apertures are formed in the end face adjacent to the periphery thereof for reasons that will become apparent later. Note FIG. 1. Further, a central circular bore is formed in the end face. Next provided as a component of each end assembly is a peripheral engagement portion. The peripheral engagement portion has a generally frusto-conical configuration with a first end having a first diameter. The first end is integrally coupled to the periphery of the closed end face. As such, an open second end is defined with a second diameter greater than the first diameter. The open second end includes a peripheral edge having an outwardly extending annular lip integrally coupled thereto and extending radially therefrom. Finally, each end assembly includes a plurality of sets of engagement members coupled to an inner surface of the peripheral engagement portion. Preferably, each set of engagement members are spaced at locations spaced about 90 degrees. The engagement members of each set each include a planar strip extending between a central extent of the periphery engagement portion and the peripheral edge thereof. Each engagement member further includes an arcuate inner engagement surface which tapers inwardly. By this structure, each end assembly may be removably coupled to an associated one of the end plates of the spool. Lastly, a post is provided having a cylindrical configuration. During use, the post is adapted for being removably and rotatably situated within the central bore of each end assembly and through the hollow central portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wire dispensing spool attachment device apparatus and method which has many of the advantages of the wire spools mentioned heretofore and many novel features that result in a new wire dispensing spool attachment device which is not anticipated, rendered obvious, suggested, or even implied by any of the prior art wire spools, either alone or in any combination thereof.

It is another object of the present invention to provide a new wire dispensing spool attachment device which may be easily and efficiently manufactured and marketed.

It is a further object of the present invention to provide a new wire dispensing spool attachment device which is of a durable and reliable construction.

An even further object of the present invention is to provide a new wire dispensing spool attachment device which is susceptible of a low cost of manufacture with regard to both materials and labor, and which accordingly is then susceptible of low prices of sale to the consuming public, thereby making such wire dispensing spool attachment device economically available to the buying public.

Still yet another object of the present invention is to provide a new wire dispensing spool attachment device which provides in the apparatuses and methods of the prior art some of the advantages thereof, while simultaneously overcoming some of the disadvantages normally associated therewith.

Still another object of the present invention is to provide a new wire dispensing spool attachment device for conveniently dispensing wire from a spool by way of removable attachments.

Even still another object of the present invention is to provide a new wire dispensing spool attachment device that includes a spool having a pair of end plates maintained fixed in parallel planes via a central portion about which a string of material may be stored. Further provided is a pair of end assemblies each having an end face and an engagement portion coupled to the end face for being removably coupled to an associated one of the end plates of the spool thereby allowing convenient dispensing of the string of material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
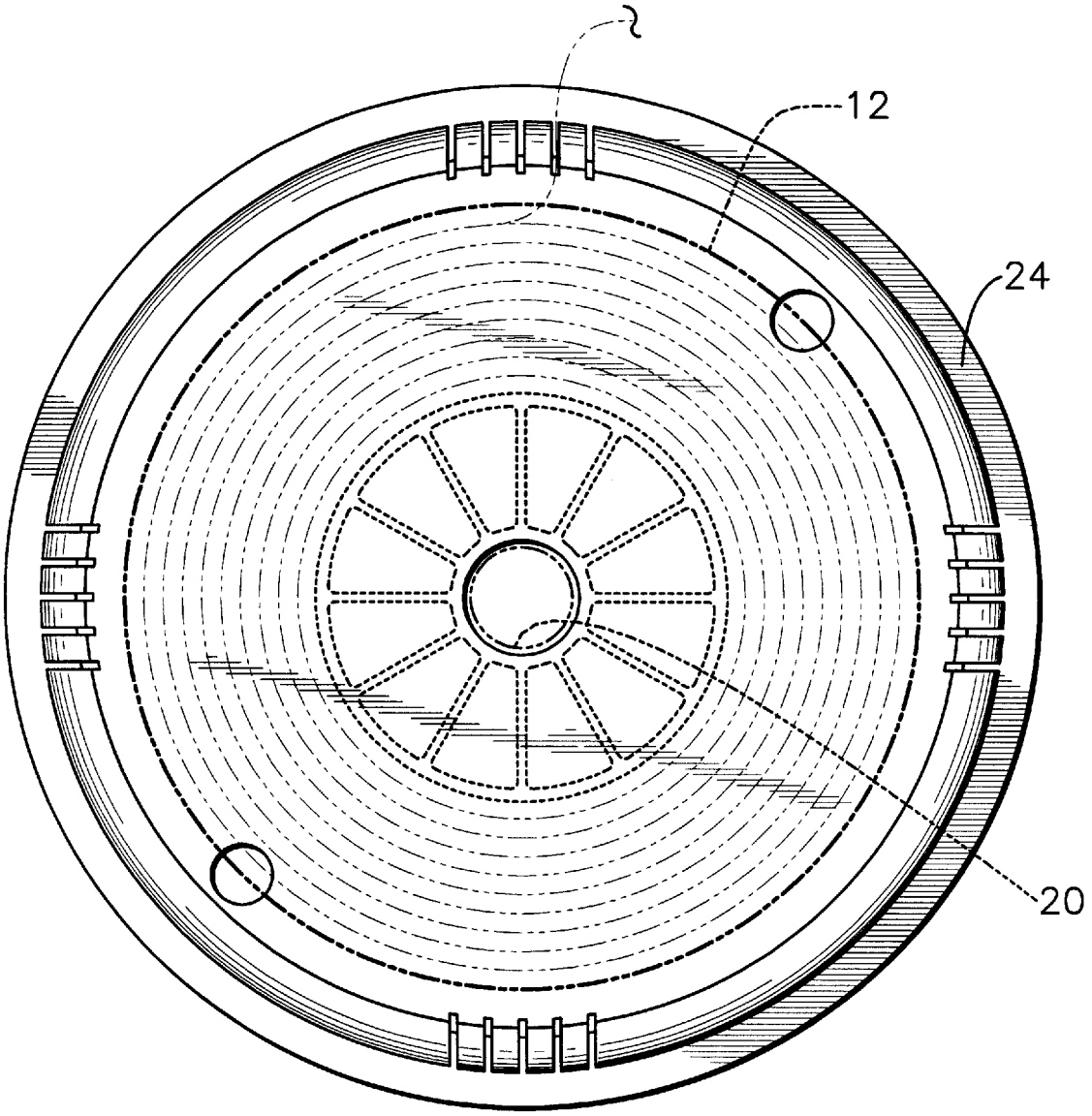
FIG. 1 is an end view of a new wire dispensing spool attachment device according to the present invention.
Figure 2:
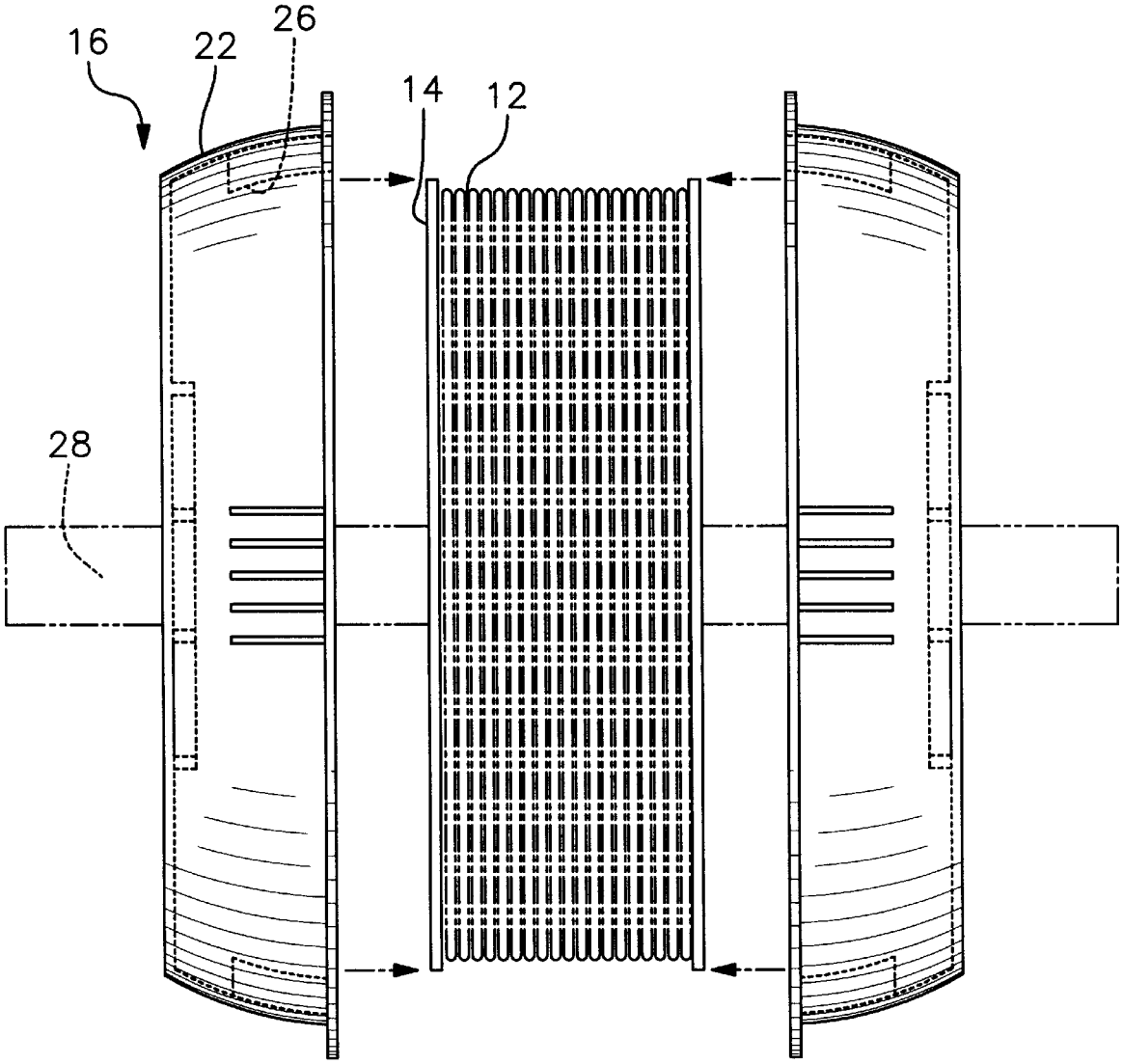
FIG. 2 is an exploded side view of the present invention.
Figure 3:
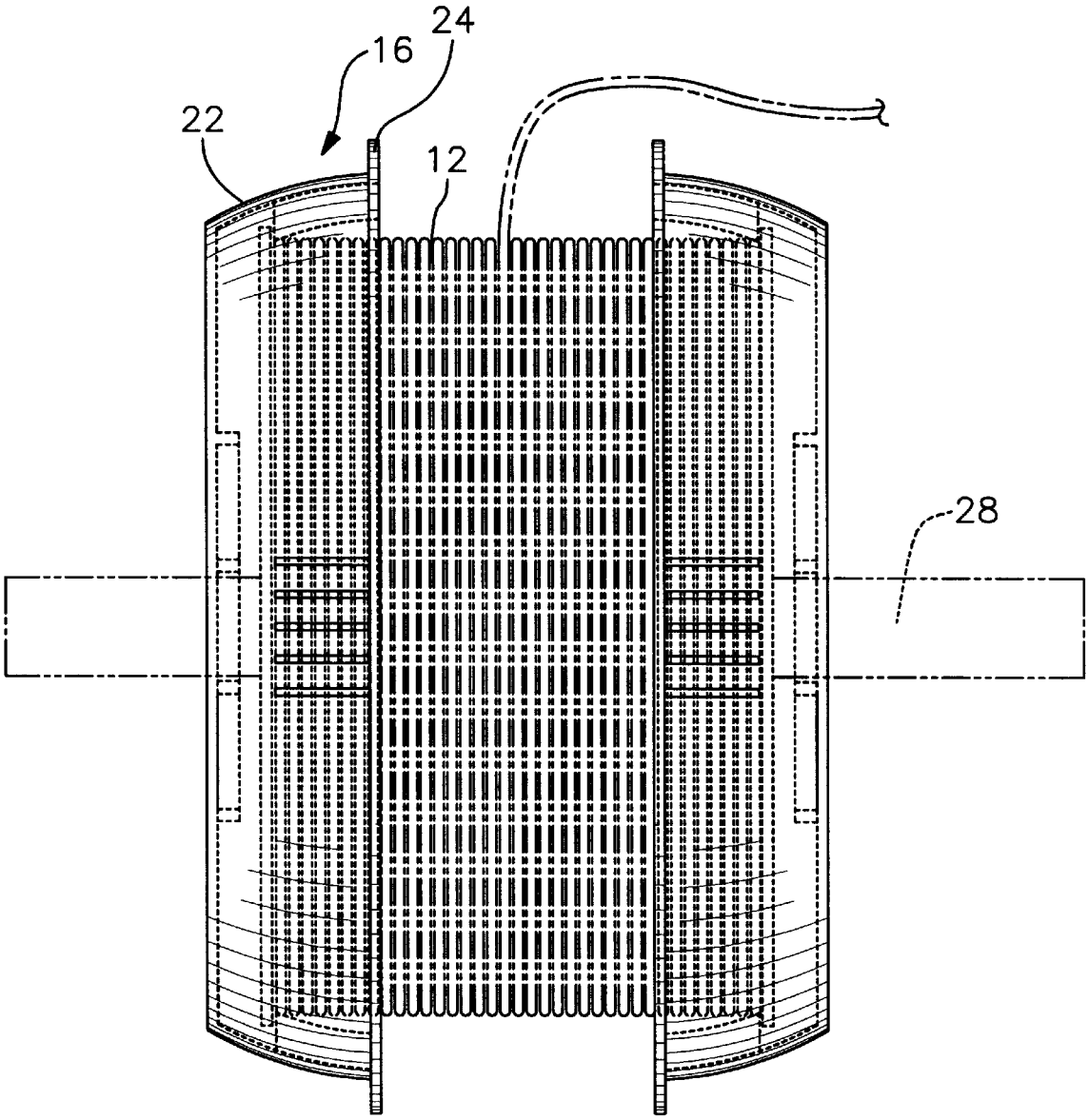
FIG. 3 is a side view of the present invention during use.

With reference now to the drawings, and in particular to FIGS. 1 through 3 thereof, a new wire dispensing spool attachment device embodying the principles and concepts of the present invention and generally designated by the reference numeral 10 will be described.

The present invention, designated as numeral 10, is adapted for use with a spool 12 having a pair of circular end plates 14 maintained fixed in parallel planes. This is accomplished via a hollow central portion about which a string of wire may be stored.

The present invention includes a pair of end assemblies 16 each including a closed end face with a planar circular configuration. The end faces of the end assemblies each have an outboard face 30, an inboard face 32, and a periphery 34 formed therebetween. A plurality of apertures 18 are formed in the end face adjacent to the periphery thereof for reasons that will become apparent later. Note FIG. 1. Further, a central circular bore 20 is formed in the end face. Ideally, the central circular bore has a strengthened periphery.

Next provided as a component of each end assembly is a peripheral engagement portion 22. The peripheral engagement portion has a generally frusto-conical configuration with a first end having a first diameter. The first end is integrally coupled to the periphery of the closed end face. As such, an open second end is defined with a second diameter greater than the first diameter. The open second end includes a peripheral edge having an outwardly extending annular lip 24 integrally coupled thereto and extending radially therefrom. As shown in the Figures, the peripheral engagement portion is preferably slightly arcuate between the first and second end.

Finally, each end assembly includes a plurality of sets of engagement members 26 coupled to an inner surface of the peripheral engagement portion. Preferably, the sets of engagement members are spaced at locations spaced about 90 degrees and each include at least 4 engagement members.

The engagement members of each set include a planar strip 36 extending between a central extent 38 of the periphery engagement portion and the peripheral edge 40 thereof. Further, each engagement member is situated within a plane which is parallel to those within which each of the other engagement members of the associated set are situated. In the preferred embodiment, each engagement member has a constant width and thickness. As such, an inner engagement surface 42 of each engagement member is slightly arcuate similar to the peripheral engagement portion.

By this structure, each end assembly may be removably coupled to an associated one of the end plates of the spool. As shown in FIG. 3, the engagement portions are forced on to the corresponding end plate of the spool until a free linear edge abuts an inner surface of the end plate. If the end plates are sized such that locking by way of the engagement members is impossible, the apertures of the end faces of the end assemblies may be used to fix the same to conventional apertures formed in the end plates of the spool via locking posts, wire or the like.

Lastly, a post 28 is provided having a cylindrical configuration. During use, the post is adapted for being removably and rotatably situated within the central bore of each end assembly and through the hollow central portion of the spool. As such, the post and end assemblies enable the convenient dispensing of the wire.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A removable auxiliary spool device comprising, in combination:

a spool having a pair of circular end plates maintained fixed in parallel planes via a hollow central portion about which a string of wire may be stored;

a pair of end assemblies each comprising:

a closed end face with a planar circular configuration having an outboard face, an inboard face, and a periphery formed therebetween, a plurality of apertures formed in the end face adjacent to the periphery thereof, a central circular bore formed in the end face, a peripheral engagement portion having a generally frusto-conical configuration with a first end having a first diameter, the first end being integrally coupled to the periphery of the closed end face thereby defining an open second end with a second diameter greater than the first diameter, wherein the open second end defines a peripheral edge having an outwardly extending annular lip integrally coupled thereto and extending radially therefrom, a plurality of sets of engagement members coupled to an inner surface of the peripheral engagement portion at locations spaced about 90 degrees, the engagement members of each set each including a planar strip extending between a central extent of the peripheral engagement portion and the peripheral edge thereof, each engagement member further including an arcuate inner engagement surface which tapers inwardly;

whereby each end assembly is sized such that the peripheral engagement portion may be removably coupled to an associated one of the end plates of the spool; and a post having a cylindrical configuration for being removably and rotatably situated within the central bore of each end assembly and further through the hollow central portion thereby allowing the convenient dispensing of the wire.

2. A removable auxiliary spool device comprising, in combination:

a spool having a pair of end plates maintained fixed in parallel planes via a central portion about which a string of material may be stored;

a pair of end assemblies each having an end face and an engagement portion coupled to the end face for being removably coupled to an associated one of the end plates of the spool, the end assemblies being spaced apart such that a portion of the spool is exposed, thereby allowing convenient dispensing of the string of material from the spool; and wherein each engagement portion includes a plurality of engagement members extending from an inner surface of each engagement portion, each of the engagement members having an inner engagement surface adapted for engaging outer peripheries of the end plates of the spool for detachably coupling the engagement portions to the spool.

3. A removable auxiliary spool device as set forth in claim 2 wherein the engagement portion has a generally frusto-conical configuration.

4. A removable auxiliary spool device as set forth in claim 2 wherein a central bore is formed in each end face for allowing a post to pass therethrough.

5. A removable auxiliary spool device as set forth in claim 2 wherein each of the end plates of the spool has a hole therethrough, a plurality of apertures being formed in the end of the engagement portion adjacent to a periphery thereof adapted for receiving a fastening means for coupling the spool to the engagement portion.

6. A removable auxiliary spool device as set forth in claim 5 wherein said fastening means comprises a wire.

* * * * *